US007707684B2

(12) United States Patent
Hittmann et al.

(10) Patent No.: US 7,707,684 B2
(45) Date of Patent: May 4, 2010

(54) IMPLEMENT HAVING ADJUSTABLE HANDLE

(75) Inventors: Markus Hittmann, Kernen (DE); Uwe Gaese, Stuttgart (DE); Klaus Langhans, Winnenden (DE)

(73) Assignee: Andreas Stihl AG & Co. KG (DE)

( * ) Notice: Subject to any disclaimer, the term of this patent is extended or adjusted under 35 U.S.C. 154(b) by 419 days.

(21) Appl. No.: 11/528,091

(22) Filed: Sep. 27, 2006

(65) Prior Publication Data

US 2007/0067947 A1 Mar. 29, 2007

(30) Foreign Application Priority Data

Sep. 28, 2005 (DE) ..... 10 2005 046 227

(51) Int. Cl.

| | |
|---|---|
| ***A47L 5/00*** | (2006.01) |
| ***A47L 9/00*** | (2006.01) |
| ***B25G 3/32*** | (2006.01) |
| ***B25G 1/10*** | (2006.01) |

(52) U.S. Cl. ..... 15/405; 15/410; 15/411; 16/422; 16/436

(58) Field of Classification Search ..... 15/405; 16/110.1, 421, 422, 430, 436
See application file for complete search history.

(56) References Cited

U.S. PATENT DOCUMENTS

| | | | | |
|---|---|---|---|---|
| 4,179,805 | A * | 12/1979 | Yamada | 30/122 |
| 4,282,652 | A * | 8/1981 | Ballas, Sr. | 30/276 |
| 4,288,171 | A * | 9/1981 | Kottke | 403/218 |
| 4,662,158 | A * | 5/1987 | Zerrer | 56/12.7 |
| 5,740,613 | A * | 4/1998 | Swistun et al. | 30/276 |
| 5,768,749 | A * | 6/1998 | Ohi et al. | 15/405 |
| 6,082,087 | A * | 7/2000 | Tada et al. | 56/255 |
| 6,305,048 | B1 * | 10/2001 | Salisian | 15/326 |
| 6,327,781 | B1 | 12/2001 | Sinclair et al. | |
| 6,701,623 | B2 * | 3/2004 | Sanders | 30/276 |
| 6,904,977 | B2 * | 6/2005 | Zerrer et al. | 172/42 |
| 2001/0014576 | A1 | 8/2001 | Mannsperger et al. | |
| 2002/0110410 | A1 | 8/2002 | Karlsson | |
| 2004/0079538 | A1 | 4/2004 | Zerrer et al. | |
| 2005/0132531 | A1 | 6/2005 | Haberlein | |

FOREIGN PATENT DOCUMENTS

| | | |
|---|---|---|
| DE | 201 15 631 | 3/2002 |
| DE | 202005001649 | 9/2005 |
| EP | 1 400 317 | 3/2004 |
| WO | WO2006/018014 | 2/2006 |

* cited by examiner

*Primary Examiner*—Bryan R Muller
(74) *Attorney, Agent, or Firm*—Robert W. Becker; Robert W. Becker & Assoc.

(57) ABSTRACT

An implement comprising a first handle, on which are disposed control elements for the implement, and a second handle. The first handle is adjustable between a first operating position for a two-handed operation in which the implement is adapted to be guided by both the first handle and the second handle, and a second operating position for one-handed operation in which the implement is adapted to be guided by the first handle.

16 Claims, 7 Drawing Sheets

IMPLEMENT HAVING ADJUSTABLE HANDLE

The instant application should be granted the priority date of Sep. 28, 2005 the filing date of the corresponding German patent application 10 2005 046 227.8-15.

BACKGROUND OF THE INVENTION

The present invention relates to an implement on which is secured a first handle, whereby the control elements, in particular the throttle trigger for operating a drive motor of the implement, are disposed on the first handle.

US 2005/0132531 A1 discloses an implement, namely a blower, having a handle for guiding the blower tube. The handle is disposed above the blower tube, and can be grasped ergonomically and conveniently only with one hand of the operator, so that the blower is suitable only for one-handed operation. Guiding the blower tube with only one hand can lead to operator fatigue.

It is therefore an object of the present application to provide an implement of the aforementioned general type that permits a fatigue-free operation and a versatile use.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
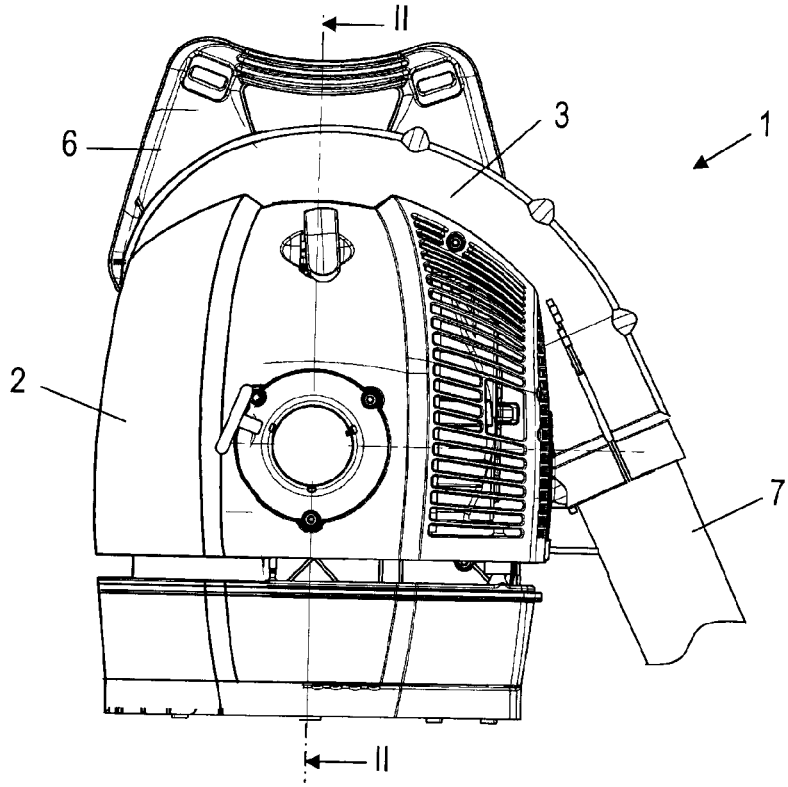
FIG. 1 shows a back view of a blower.

The implement of the present application also comprises a second handle, wherein the first handle is adjustable between a first operating position for a two-handed operation in which the implement is adapted to be guided by both the first handle and the second handle, and a second operating position for one-handed operation in which the implement is adapted to be guided by the first handle. Alternatively, the implement of the present application also comprises a tubular section and a clamp that is detachably mounted on the tubular section, wherein the first handle is detachably mounted on the clamp.

Due to the fact that the implement of the present application has a second handle, the implement can also be guided with two hands, in other words in a two-handed operation. This reduces operator fatigue. In this way, ergonomic grip operations that permit a low-fatigue operation are possible not only for the one-handed operation but also for the two-handed operation. Since the second handle can be displaced or adjusted into a non-operative position, it is possible, where this is advantageous, to have the previously known one-handed operation. The second handle, in addition to the previous one-handed operation, thus also enables a two-handed operation, so that the implement can be used in various ways and permits a low-fatigue operation.

The two handles can be held on a handle frame and can be pivotable about a common axis of rotation between the two positions. Preferably, the handle frame is pivoted about the axis of rotation between the two positions by about 90°. An axis of rotation of about 90° makes it possible for the second handle to be pivoted into a non-operative position that is entirely out of the operating range and does not obstruct the operator. A straightforward configuration results if the handle frame is formed of a bent tubular portion.

In the operating position for two-handed operation, the ends of the two handles that face away from the handle frame are advantageously inclined relative to one another. This results in an ergonomic position of the hands during the two-handed operation and during the one-handed operation. The first handle can be mounted on the handle frame so as to be rotatable about its longitudinal direction. As a result, in both operating positions the first handle can have approximately the same orientation relative to the implement, so that for example the arrangement of control elements or the like on the first handle is the same in both operating positions. The first handle is preferably pivoted by about 90° relative to the handle frame between the first and the second operating positions. The pivot angle of the first handle in this connection expediently corresponds to the pivot angle of the handle frame between the two positions, whereby the first handle is rotated in the opposite direction to the handle frame, so that the absolute orientation of the first handle remains approximately the same. A straightforward configuration results if the first handle is secured to the handle frame via a fixing means, in particular a setscrew, that is secured in different positions on the handle frame in the first and the second operating positions. The setscrew can be easily and rapidly loosened by the operator and changed over. As a result, a rapid, simple change between the two operating positions can be achieved. To fix the handle in the various positions, no additional components, other than the setscrew that is required anyway for securement, are necessary. The control elements, especially the throttle trigger for operating a drive motor of the implement, can be arranged on the first handle.

The two handles can be secured to a tubular section of the implement. The handles thus serve to guide the tubular section of the implement relative to the ground. An ergonomic arrangement of the two handles is achieved if in the operating position for the two-handed operation, the two handles are disposed in the plane that lies transverse, in particular approximately perpendicular, to the longitudinal direction of the tubular direction. In the operating position for a one-handed operation, the two handles are preferably disposed in a plane that lies approximately parallel to the longitudinal direction of the tubular section. As a result, both handles can be disposed in the region of the tubular section. A good introduction of force into the tubular section from the first handle thus results, so that the implement is easy to handle. The second handle is preferably also disposed in the region of the tubular section, thus avoiding an obstruction to the operator by the second handle.

In both operating positions, the first handle is preferably disposed at approximately the same height or level relative to the longitudinal direction of the tubular section. An ergonomic hand position of the operator thus results in both operating positions. At the same time, the length of a gas cable that is to be controlled via a control lever on the first handle, does not significantly change during the adjustment between the two operating positions, resulting in a structurally straightforward configuration. The second handle, in a non-operative position, is expediently disposed in the longitudinal direction of the tubular section on that side of the first handle that is remote from the operator. The first handle and the second handle, in the operating position for one-handed operation, are preferably inclined relative to the longitudinal axis of the tubular section of the implement. This results in an ergonomic hand position on the first handle during the one-handed operation and in an ergonomic position of both hands during the two-handed operation.

A straightforward configuration of the handle frame is achieved if a section of the handle frame extends on that longitudinal side of the tubular section that is opposite the two handles. The handle frame is preferably secured to the tubular section of the implement by means of a detachable clamp. Due to the fact that the clamp is detachably disposed on the tubular section, instead of the clamp for the handle frame having two handles, a clamp for the arrangement of a single handle can be secured to the tubular section. As a result, the implement can also be operated as previously with a single handle. The clamp expediently has a mounting support in which the handle frame is disposed in such a way as to be rotatable about the axis of rotation. As a result, a rotatability of the handle frame can be realized in a structurally straightforward manner.

The implement is in particular an implement that can be carried on an operator's back, preferably a blower, a suction device or a sprayer. The tubular section is in particular a section of the blower tube of the implement.

A versatile use of an implement to which is secured a first handle can be provided if the first handle is secured to a tubular section of the implement via a clamp, whereby a handle is detachably mounted on the clamp and the clamp is mounted on the tubular section. As a result, it is possible to exchange the first handle by a handle frame to which is secured a second handle, so that the implement can be guided not only with a single handle but also with two handles. This enables a flexible utilization of the implement. By means of the detachable mounting of the first handle on the clamp, the handle can be mounted on a handle frame, so that the control elements disposed on the first handle are available to the operator. It can be advantageous to have only one clamp for fixation of either the handle frame or a single handle to the tubular section. It can be advantageous that the clamp is detachably mounted on the tubular section. In this way it is possible to have different clamps for fixation of the handle or the handle frame to the tubular section.

Further specific embodiments of the present application will be described in detail subsequently.

DESCRIPTION OF SPECIFIC EMBODIMENTS

Figure 2:
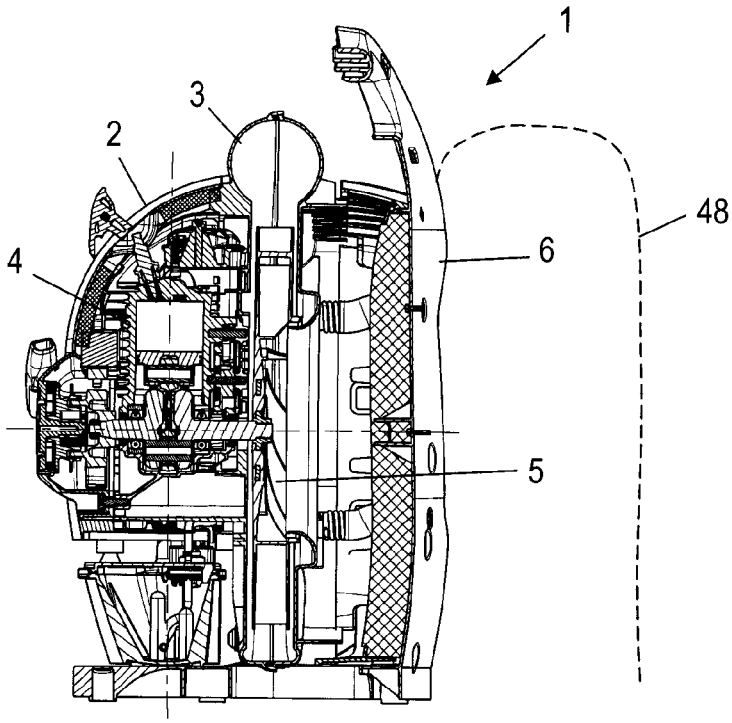
FIG. 2 is a cross-sectional view taken along the line II-II in FIG. 1.

Referring now to the drawings in detail, the blower 1 shown in FIGS. 1 and 2 has a housing 2 in which is disposed a drive motor 4 which is preferably an internal combustion engine, such as a two-cycle engine or a four-cycle engine. The drive motor 4 drives an impeller 5 that conveys air into a blower spiral or volute 3, on which is disposed a blower or discharge tube 7. The housing 2 is secured to a backpack 6, so that the operator 48 can carry the blower 1 on his or her back. The blower tube 7 is guided around the body of an operator, is held by the operator, and is guided over the ground, so that dirt, leaves or the like can be removed from the ground. By means of the blower or discharge tube 7, the implement can also be used as a sprayer or as a suction device.

Figure 3:
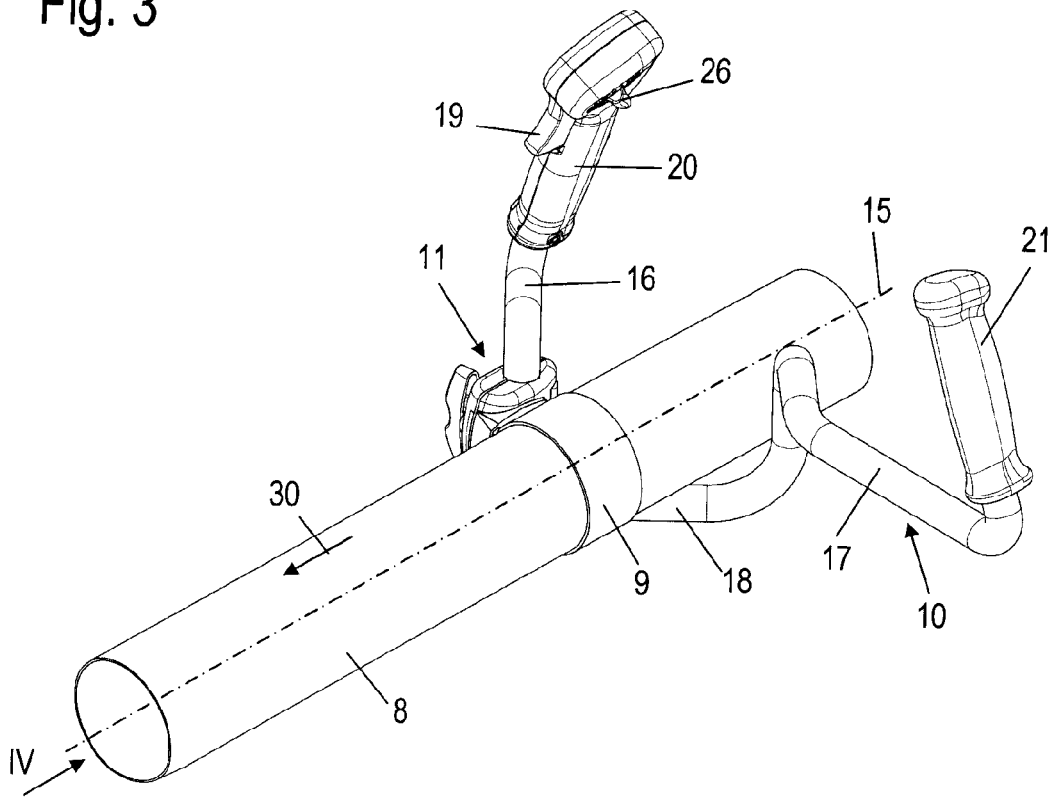
FIG. 3 is a perspective illustration of the handle frame of the blower in the position for two-handed operation.

For guiding the blower tube 7, the blower 1 has the grip or handle frame 10 shown in FIG. 3; secured to the handle frame 10 are a first handle 20 and a second handle 21. The handle frame 10 is formed of a bent tube onto the ends of which the handles 20 and 21 are placed and fixed. By means of a clamp 9, the handle frame 10 is secured in place on a section 8 of the blower tube 7 through which the air conveyed by the impeller 5 flows in the direction of flow 30.

Figure 4:
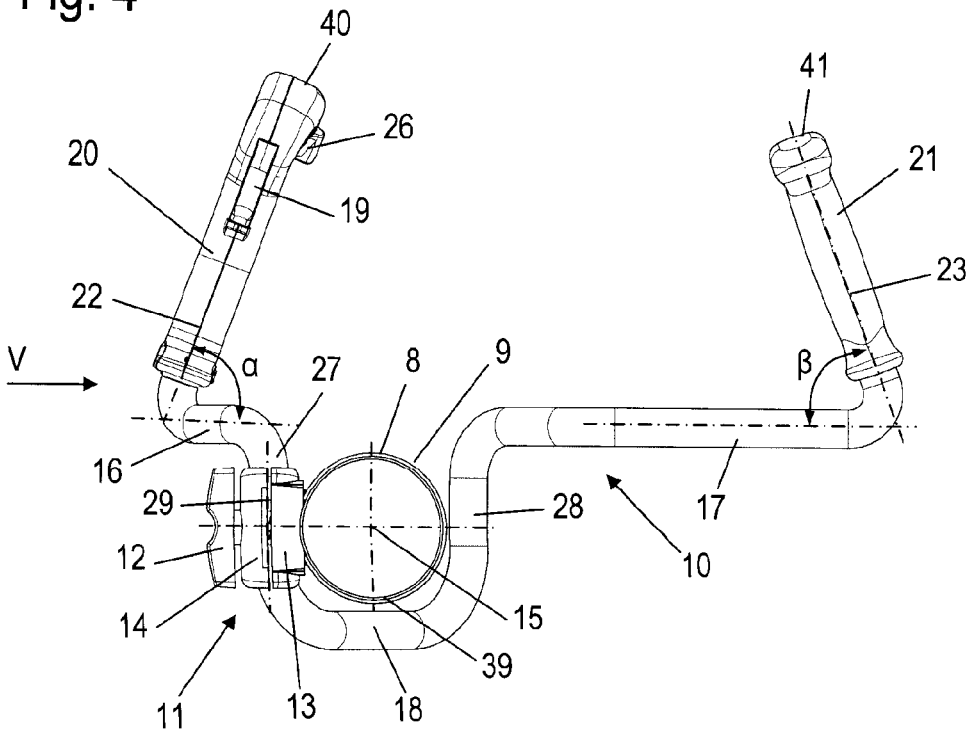
FIG. 4 is a side view of the handle frame taken in the direction of the arrow IV in FIG. 3.
Figure 5:
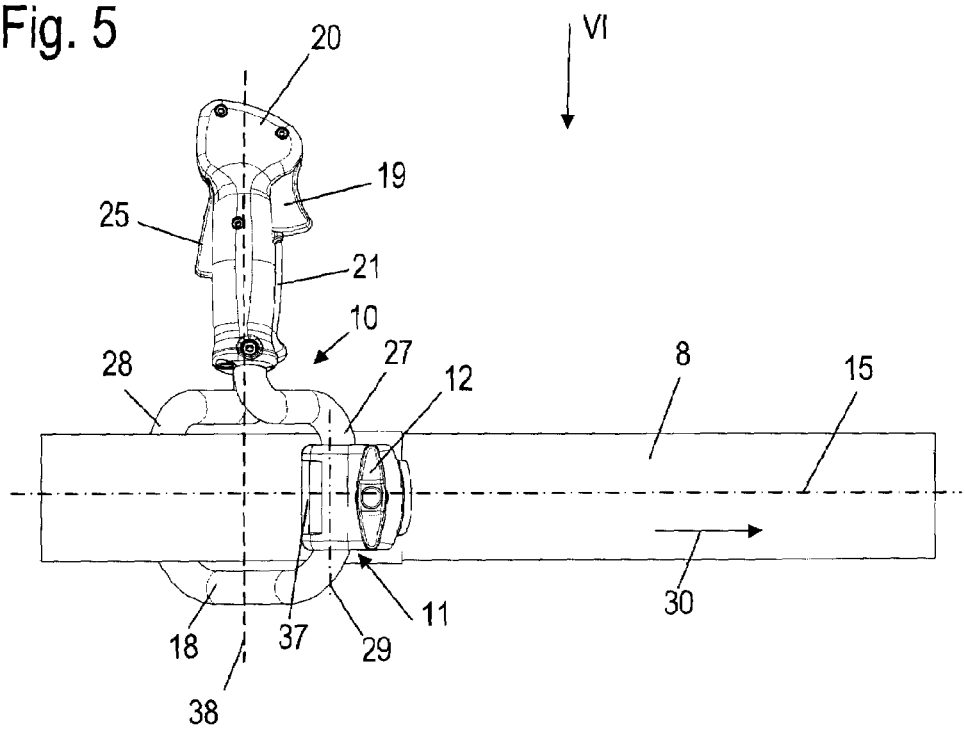
FIG. 5 is a side view of the handle frame taken in the direction of the arrow V in FIG. 4.

Secured to the clamp 9 is a mounting support 11 in which the handle frame 10 is held. As shown in FIG. 4, the mounting support 11 has a first half sleeve 13, which is secured to the clamp 9. Mounted on the first half sleeve 13 is a second half sleeve 14, which is pivotably disposed on the first half sleeve 13 on the hinge 37, which is shown in FIG. 5. Secured to the second half sleeve 14 is a wing screw 12, which can be screwed into the first half sleeve 13. The handle frame 10 is disposed in the mounting support 11 so as to be rotatable about an axis of rotation 29. As shown in FIG. 5, the wing screw 12 is disposed on that side of the axis of rotation 29 that is opposite the hinge 37, so that the tubular handle frame 10 can be securely clamped in the mounting support 11.

The first handle 20 is secured to a section 16 of the handle frame 10. The first handle 20 has a throttle trigger 19, a throttle lock 25 which is shown in FIG. 5, as well as the control lever 26, which is shown in FIGS. 3 and 4 and can serve, for example, for setting a choke or for fixing the throttle in one or in different positions. The second handle 21 is fixed to a section 17 of the handle frame 10. The sections 16 and 17 of the handle frame 10 are connected via a section 18 thereof that is disposed on the longitudinal side 39 of the section 8 of the blower tube 7 opposite the two handles 20 and 21.

In the view of the handle frame 10 in the longitudinal direction 15 of the section 8 of the blower tube 7 shown in FIG. 4, the sections 16, 17, and 18 of the handle frame 10 extend parallel to one another and perpendicular to the axis of rotation 29. The section 27, which connects the section 16 with the section 18, and the section 28 of the handle frame 10 that is disposed on the opposite side of the blower tube section 8, extend parallel to the axis of rotation 29. The sections 27, 18 and 28 form a U-shaped receiver in which the section 8 of the blower tube 7 is disposed. This section 8 has a cylindrical configuration. The longitudinal direction 15 coincides with the longitudinal central axis of the section 8.

The longitudinal direction 22 of the first handle 20 is inclined relative to the section 16 of the handle frame 10 by an angle a, which is less than 90°. The longitudinal direction 23 of the second handle 21 is inclined relative to the section 17 of the handle frame 10 by an angle $\beta$, which is less than 90°. In this connection, the ends 40 and 41 of the handles 20 and 21 that face away from the handle frame 10 are inclined relative to one another. The angles $\alpha$ and $\beta$ are preferably the same, and can, for example, be about 70°.

In the side view of the handle frame 10 shown in FIG. 5, the two handles 20 and 21 are disposed so as to be approximately aligned with one another. The two handles 20, 21 are disposed in a plane 38 that extends perpendicular to the longitudinal direction 15 of the section 8 of the blower tube 7.

Figure 6:
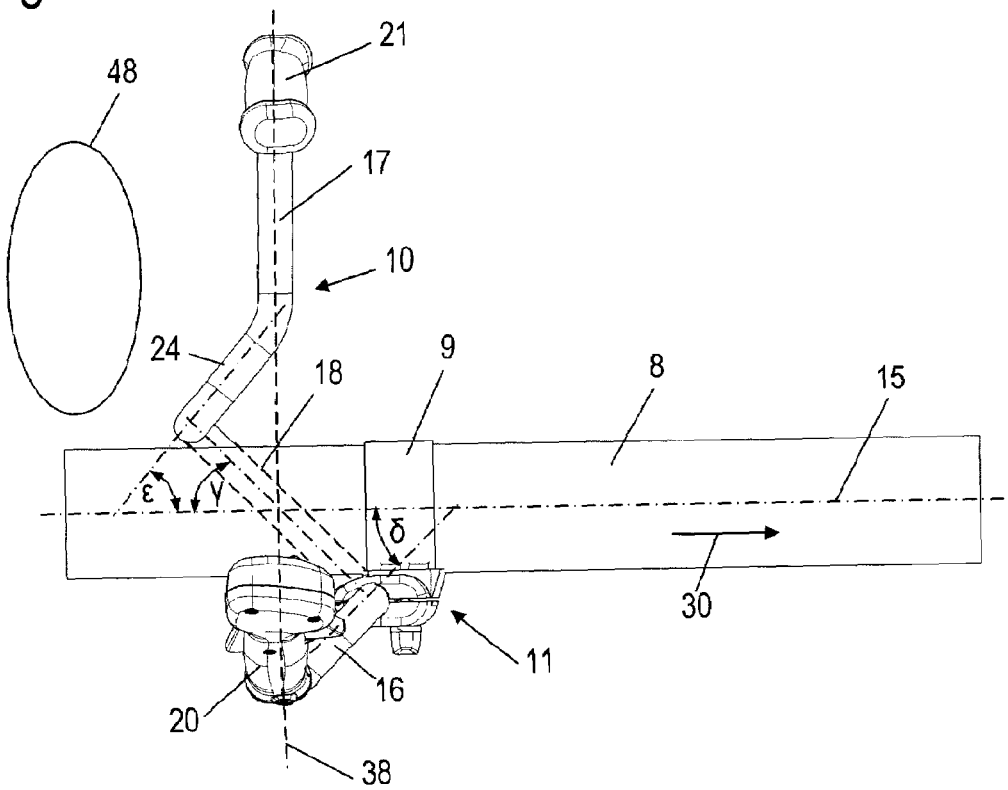
FIG. 6 is a plan view onto the handle frame taken in the direction of the arrow VI in FIG. 5.
Figure 7:
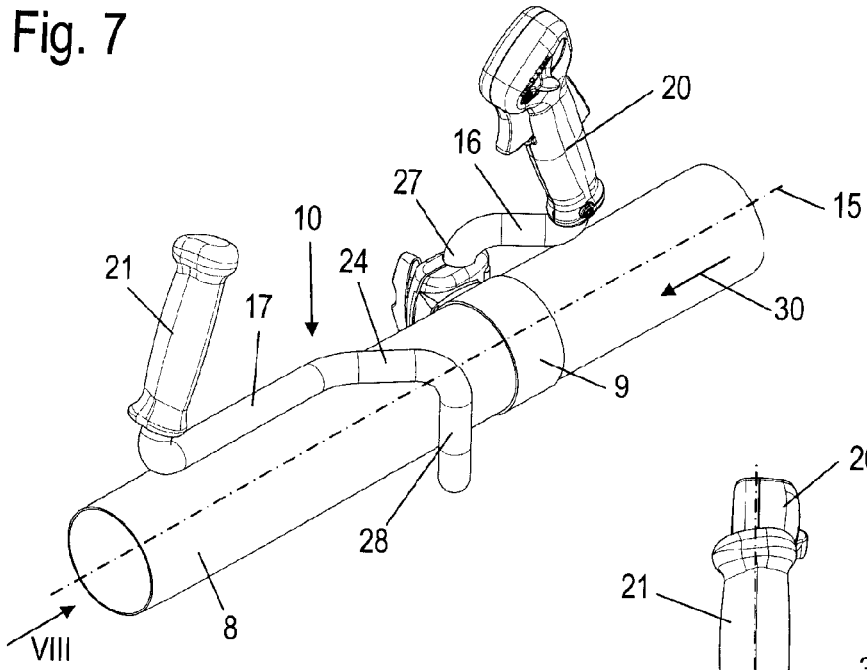
FIG. 7 is a perspective illustration of the handle frame in the position for one-handed operation.

In FIG. 6, the handle frame 10 is shown in a plan view. The section 17 of the handle frame 10 is connected with the section 28 (FIG. 4) via a section 24 that is inclined relative to the longitudinal direction 15 by an angle $\in$. The section 16 is inclined relative to the longitudinal direction 15 by an angle $\delta$ that preferably corresponds approximately to the angle $\in$. The section 18 extends approximately perpendicular to the section 16 and 24 and is inclined relative to the longitudinal direction 15 by an angle $\gamma$. The angles $\gamma$, $\delta$, $\in$ are preferably approximately 45°. The section 17 extends perpendicular to the longitudinal direction 15. The operator 48, who is schematically indicated in FIG. 6, generally stands on the side of the section 8 of the blower tube 7, on which side the second handle 21 is also disposed. Thus, relative to the direction of flow 30, the operator 48 stands upstream of the handle frame 10.

In FIGS. 3 to 6, the handle frame 10 is shown in the position for the two-handed operation. Not only the handle 20, but also the handle 21, are disposed in the operating position. Both handles 20 and 21 can be comfortably grasped by the operator 48. In order to be able to guide the section 8 of the blower tube 7 with only one hand, the handle frame 10 can be pivoted into the position shown in FIGS. 7 to 10. In this connection, the handle frame 10 is pivoted by preferably approximately 90° about the axis of rotation 29. In addition, the first handle 20 is pivoted relative to the handle frame 10 in the opposite direction by 90°. In so doing, the second handle 21 comes to rest in a non-operative position in which it is beyond the reach of the operator.

To be able to pivot the handle frame 10, the wing screw 12 of the mounting support 11 is loosened and the handle frame 10 is pivoted. In the position shown in FIGS. 3 to 6, the section 28 of the handle frame 10 is disposed upstream of the clamp 9 nearly against the section 8 of the blower tube 7. During the displacement or adjustment, the handle frame 10 is pivoted to such an extent that the section 28 comes to rest nearly against the blower tube 7 downstream of the clamp 9. This position of the handle frame is shown in FIGS. 7 to 10.

Figure 11:
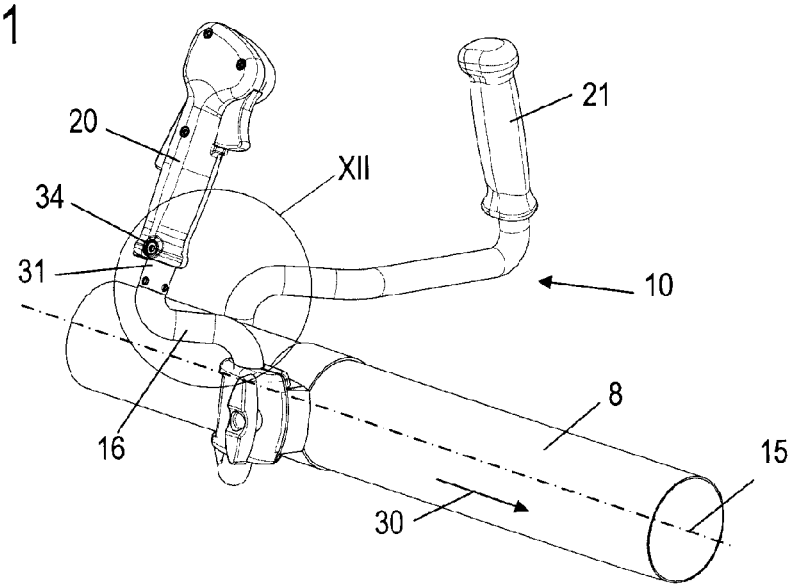
FIG. 11 is a perspective illustration of the handle frame with the first handle partially disassembled.
Figure 12:
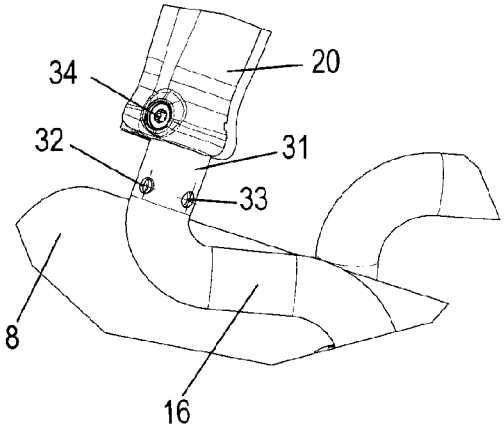
FIG. 12 is an enlarged illustration of the portion XII in FIG. 11.
Figure 13:
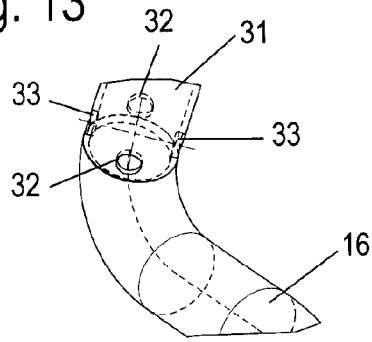
FIG. 13 is an enlarged perspective illustration of a tubular section of the tubular handle.

The adjustment of the first handle 20 is shown in FIGS. 11 to 13. The first handle 20 is mounted on a tubular section 31 of the handle frame 10 that adjoins the section 16 of the handle frame. In FIG. 11, the first handle 20 is partially pulled off of the section 31. As shown in the enlarged illustration of FIG. 12, the tubular section 31 has transverse bores 32 and 33. As shown in FIG. 13, the transverse bores 32 and 33 are embodied as through bores, so that in each case two oppositely disposed openings are disposed in the hollow tubular section 31. A fixing screw or setscrew 34 is disposed on the first handle 20. The transverse bores 32 and 33 are offset relative to one another by 90° about the longitudinal axis of the tubular section 31. In order to adjust the first handle 20 on the handle frame 10, the setscrew 34 is loosened, the first handle 20 is rotated by 90°, and the setscrew 34 is subsequently again screwed in. In this connection, for the two-handed operation the setscrew 34 is screwed into the transverse bore 32, and for the single-handed operation is screwed into the transverse bore 33.

Of course, instead of the setscrew 34 other fastening means, such as a split pin or the like, could also be provided. Instead of the transverse bore, a recessed portion can also be provided in the tubular section 31. The securing means can also be in the form of a spring-loaded securing means, such as a spring-loaded ball that cooperates with the bore or the recessed portion.

Figure 8:
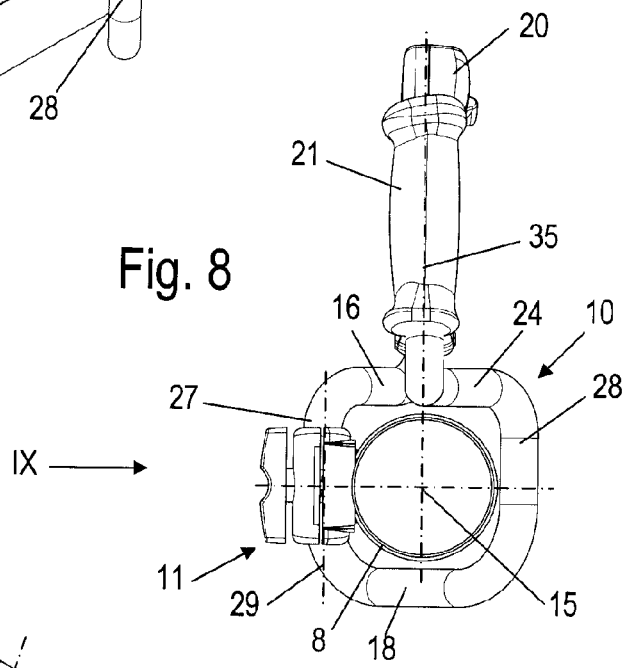
FIG. 8 is a side view of the handle frame taken in the direction of the arrow VIII in FIG. 7.

In the position of the handle frame 10 shown in FIGS. 7 to 10 for the one-handed operation, the first handle 20 is disposed upstream of the clamp 9 and the second handle 21 is disposed downstream of the clamp 9. As shown in FIG. 8, the two handles 20, 21 are disposed in a common plane 35 that also contains the longitudinal direction 15 of the section 8 of the blower tube 7. The section 28 is disposed nearly against the circumference of the section 8 of the blower tube 7. In the side view of the handle frame 10 shown in FIG. 8 taken in the longitudinal direction, the handle frame 10 extends around the section 8 of the blower tube 7.

Figure 9:
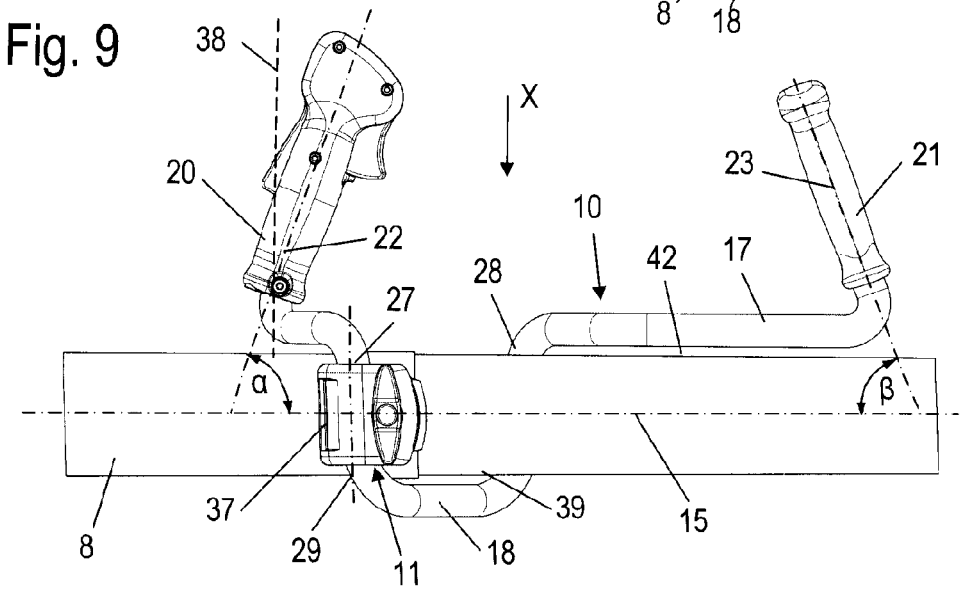
FIG. 9 is a side view of the handle frame taken in the direction of the arrow IX in FIG. 8.

As shown in the side view FIG. 9, the longitudinal direction 22 of the first handle 20 is inclined relative to the longitudinal direction 15 by the angle a. The longitudinal direction 23 of the second handle 21 is inclined relative to the longitudinal direction 15 by the angle $\beta$. The section 17 of the handle frame 10 extends parallel to the longitudinal direction 15 on the longitudinal side 42 of the section 8 that is opposite the longitudinal side 39 thereof. The section 18 of the handle frame 10 is disposed on the longitudinal side 39. During operation, the longitudinal side 42 faces upwardly and the longitudinal side 39 faces downwardly. In this connection, the longitudinal direction 15 of the section 8 of the blower tube 7 can be inclined relative to the ground.

Figure 10:
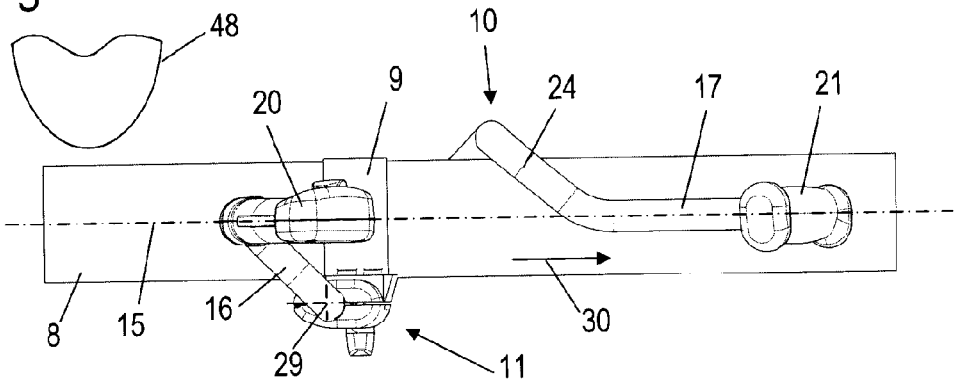
FIG. 10 is a plan view onto the handle frame taken in the direction of the arrow X in FIG. 9.

The position of the operator 48 is schematically indicated in FIG. 10. The operator stands upstream of the first handle 20 to the side of the blower tube 7. The second handle 21 is on that side of the first handle 20 that faces away from the operator. The second handle 21 can not be grasped by the operator 48 in this position. Due to the fact that the second handle 21 is disposed in the region of the section 8 of the blower tube 7 and downstream of the first handle 20, the operator is not obstructed by the second handle 21. In this non-operative position of the second handle 21, the blower tube 7 is guided only by the first handle 20. In the position for the two-handed operation, the two handles 20 and 21 are disposed on both sides of the section 8 of the blower tube 7. In the position for the single-handed operation, both handles 20, 21 are disposed above the section 28 of the blower tube 7. Consequently, a favorable introduction of force to the handle frame 10 and the blower tube 7 results for both operating positions.

Figure 14:
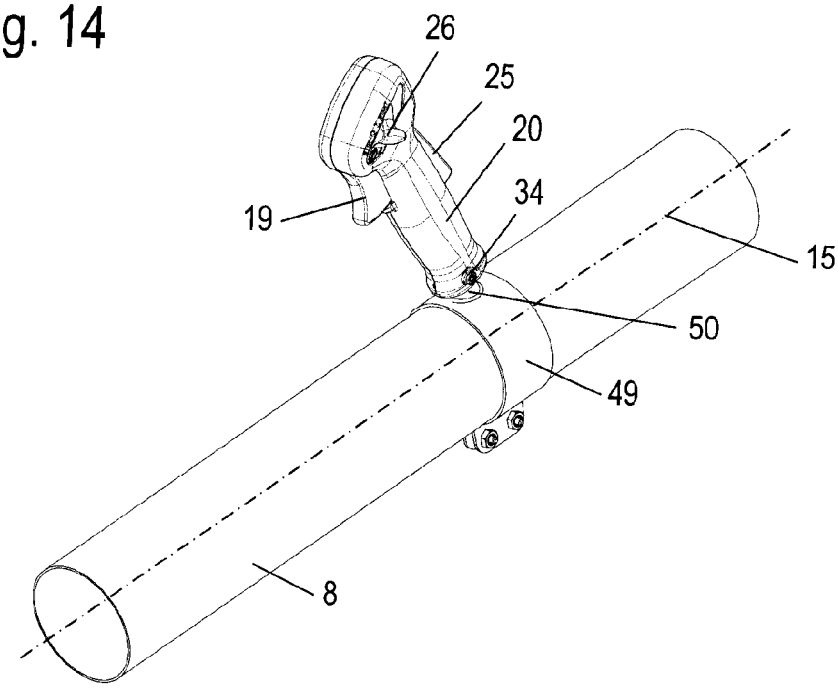
FIG. 14 shows the blower tube of the blower of FIGS. 1 and 2 with one handle for one-handed operation.

The clamp 9 is detachably secured to the section 8 of the blower tube 7. As a result, the clamp 9, along with the handle frame 10, can be detached from the section 8 of the blower tube 7. Instead of the clamp 9 and the tubular handle frame 10, the clamp 49 having the short tube 50 shown in FIG. 14 can be secured to the section 8. The first handle 20 can be fixed on the short tube 50 via the set screw 34. As a result, the blower tube 7 can also be used with a previously conventional handle for single-handed operation if a two-handed operation is not desired. In this connection, the handle 20 is detachably fixed to the clamp 49, and the clamp 49 is detachably fixed to the blower tube 7.

Figure 15:
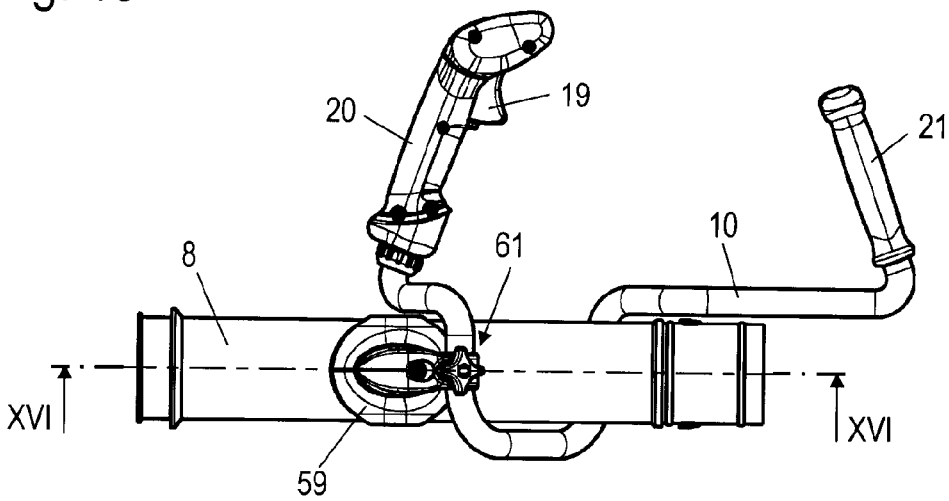
FIG. 15 is a side view of an embodiment of a blower tube with a handle frame.
Figure 16:
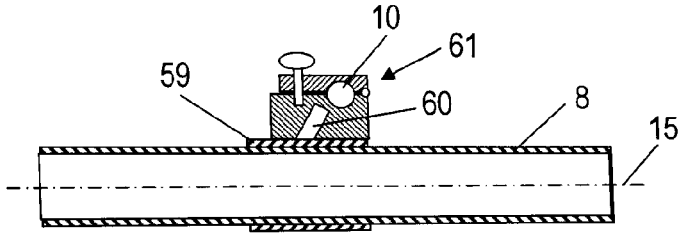
FIG. 16 is a cross-sectional view taken along the line XVI-XVI in FIG. 15.

FIG. 15 shows another embodiment of a section 8 of a blower tube 7 with a clamp 59. The clamp 59 has a mounting support 61 in which a handle frame 10 is held. The handle frame 10 of FIG. 15 corresponds to the handle frame 10 of FIG. 3 to FIG. 13 and has the same construction. As shown in FIG. 16 the mounting support 61 is detachably fixed on a short tube 60 of the clamp 59. The short tube 60 is firmly connected to the clamp 59 and extends in a lateral direction of the section 8 of the blower tube 7.

Figure 17:
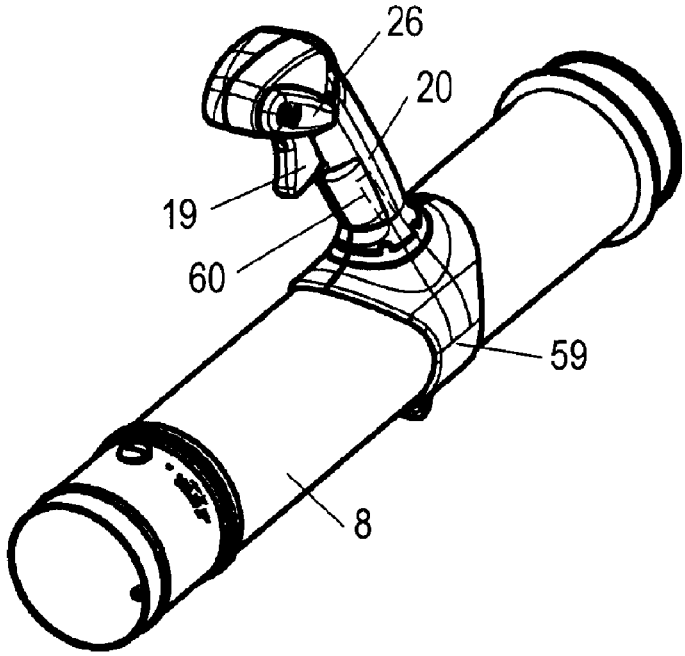
FIG. 17 shows the blower tube of FIG. 15 with one handle for one-handed operation.

As shown in FIG. 17, the handle 20 can be connected directly to the clamp 59 for single-handed operation if a two-handed operation is not desired. To use the clamp 59 with the handle 20, the mounting support shown in FIGS. 15 and 16 is detached from the short tube 60 and the handle 20 is detached from the handle frame 10. Then the clamp 59 is turned around the longitudinal direction 15 until the short tube 60 is in an upright position and the handle 20 is directly secured to the short tube 60 of the mounting support 61. The clamp 59 is advantageously turned about an angle of approximately 90°. Because either the mounting support 61 or the handle 20 can be secured to the short tube 60, only one clamp 59 is needed for fixation of the handle frame 10 or of the handle 20 to the blower tube 7.

The handle frame 10 can also be used on a tubular section of a suction or spray device. Use on other implements, especially on implements having a tubular section on which the handle frame can be secured, can also be advantageous.

The specification incorporates by reference the disclosure of German priority document 10 2005 046 227.8-15 filed Sep. 28, 2005.

The present invention is, of course, in no way restricted to the specific disclosure of the specification and drawings, but also encompasses any modifications within the scope of the appended claims.

We claim:

1. An implement, comprising:

a first handle, on which is disposed a control element in the form of a throttle trigger for a drive motor of the implement;

a second handle, wherein said first handle is adjustable between a first operating position for a two-handed operation in which the implement is adapted to be guided by both said first handle and said second handle, and a second operating position for one-handed operation in which the implement is adapted to be guided by said first handle; and a handle frame, wherein said first handle and said second handle are disposed on said handle frame, further wherein said first handle and said second handle are pivotable together with said handle frame about a common first axis between said first and second operating positions, further wherein said first handle is mounted on said handle frame in such a way as to be rotatable relative to said handle frame about a longitudinal direction of said first handle about a second axis, further wherein said first handle is adapted to alternatively be secured to said handle frame in said first and said second operating positions, further wherein a pivot angle of said first handle about said second axis corresponds approximately to a pivot angle of said handle frame between said two positions about said first axis, and wherein said first handle is rotatable about said second axis in a direction opposite to the pivoting direction of said handle frame about said first axis such that in said first and second operating positions said throttle trigger is adapted to face generally the same direction relative to said implement.

2. An implement according to claim 1, wherein said second handle is adjustable between an operating position for said two-handed operation and a non-operative position for said one-handed operation.

3. An implement according to claim 1, wherein said handle frame is adapted to be pivoted about said first axis of rotation between said two operating positions by about 90°.

4. An implement according to claim 1, wherein said handle frame is formed from a bent tubular portion.

5. An implement according to claim 1, wherein in said operating position for said two-handed operation, ends of said two handles that face away from said handle frame are inclined relative to one another.

6. An implement according to claim 1, wherein said first handle is adapted to be pivoted by approximately 90° relative to said handle frame between said first operating position and said second operating position.

7. An implement according to claim 1, wherein said first handle is secured to said handle frame via a fixing structure that in said first and second operating positions is secured to said handle frame in different positions.

8. An implement according to claim 1, wherein said implement has a tubular section, and wherein said two handles are secured to said tubular section.

9. An implement according to claim 8, wherein in said operating position for said two-handed operation, said two handles are disposed in a plane that lies transverse to a longitudinal direction of said tubular section, and wherein in said operating position for said one-handed operation, said two handles are disposed in a plane that lies approximately parallel to said longitudinal direction of said tubular section.

10. An implement according to claim 8, wherein in both of said operating positions, said first handle, relative to a longitudinal direction of said tubular section, is disposed generally in the region of the same plane, which extends transverse to said longitudinal direction of said tubular section.

11. An implement according to claim 8, wherein said tubular section has a distal end from said first pivot axis, and wherein in a non-operative position, said second handle is disposed in a longitudinal direction of said tubular section that is closer to said distal end than said first handle.

12. An implement according to claim 8, wherein in said operating position for said one-handed operation, said first handle and said second handle are inclined relative to a longitudinal direction of said tubular section.

13. An implement according to clam 8, wherein a handle frame is provided, and wherein a section of said handle frame extends on a longitudinal side of said tubular section that is opposite said two handles.

14. An implement according to claim 8, wherein said handle frame is secured via a detachable clamp to said tubular section, and wherein said clamp is provided with a mounting support in which said handle frame is disposed in such a way as to be rotatable about said first axis of rotation.

15. An implement according to claim 1, wherein said implement is an implement that is adapted to be carried on the back of an operator.

16. An implement according to claim 15, wherein said implement has a blower tube, and wherein said implement has a tubular section that is a section of said blower tube.

* * * * *